United States Patent [19]

Andis

[11] Patent Number: 4,549,560

[45] Date of Patent: Oct. 29, 1985

[54] HAIR CURLING APPLIANCE WITH ELASTOMER MATERIAL COVERING HEATING ELEMENT

[75] Inventor: Matthew L. Andis, Racine, Wis.

[73] Assignee: Andis Company, Racine, Wis.

[21] Appl. No.: 591,130

[22] Filed: Mar. 19, 1984

[51] Int. Cl.[4] ..... A45D 2/24

[52] U.S. Cl. ..... 132/37 R; 219/222

[58] Field of Search ..... 132/37 R, 33, 9, 40, 132/42; 219/222

[56] References Cited

U.S. PATENT DOCUMENTS

| | | | |
|---|---|---|---|
| 372,092 | 10/1887 | Stansbury | 132/37 R |
| 669,460 | 3/1901 | Haug | 132/37 R |
| 1,018,673 | 2/1912 | Madsen | 132/37 R |
| 2,254,266 | 9/1941 | Cannon | 132/37 R |
| 3,486,000 | 12/1969 | D'Elia et al. | 219/222 |
| 3,527,237 | 9/1970 | Abe | 219/222 |

*Primary Examiner*—Gregory E. McNeill

*Attorney, Agent, or Firm*—Michael, Best & Friedrich

[57] ABSTRACT

A hair curling appliance including a handle, and a heating element including a metal cylinder fixedly extending from the handle and including an outer surface, and an outer covering which is made of elastomer material and which substantially covers the outer surface of the metal cylinder.

18 Claims, 3 Drawing Figures

HAIR CURLING APPLIANCE WITH ELASTOMER MATERIAL COVERING HEATING ELEMENT

BACKGROUND OF THE INVENTION

This invention relates to hair curling appliances and, more particularly, to hair curling appliances including a heating element with an outer covering.

Prior hair curling appliances have included heating elements including a metal cylinder upon which hair is wrapped to heat and curl hair. The Clairol Company has sold a hair curling appliance including a heating element with an outer covering of nylon fuzz or flocked type of material.

SUMMARY OF THE INVENTION

This invention provides a hair curling appliance including a handle, and a heating element including a metal cylinder fixedly extending from the handle and including an outer surface, and an outer covering which is made of elastomer material and which substantially covers the outer surface of the metal cylinder.

In one embodiment, the outer covering includes a generally smooth outer surface, and the outer covering is attached to the metal cylinder.

In another embodiment, the appliance includes an inner metal tube which telescopically receives the metal cylinder, and the outer covering substantially covers the outer surface of the inner metal tube and the inner metal tube is slidable relative to the metal cylinder.

The hair curling appliance can further include a clamping assembly for clamping hair to the heating element.

In one embodiment, the elastomer material is an elastomeric plastic, or, more specifically, a thermoplastic polyefinic compound with a hardness ranging between 73 shore A and 50 shore D.

One of the principal features of the invention is the provision of a hair curling appliance which provides for greater user comfort in wrapping hair around the curling appliance heating element.

Other features and advantages of embodiments of the invention will become apparent upon reviewing the following drawings, detailed description and the appended claims.

Figure 1:
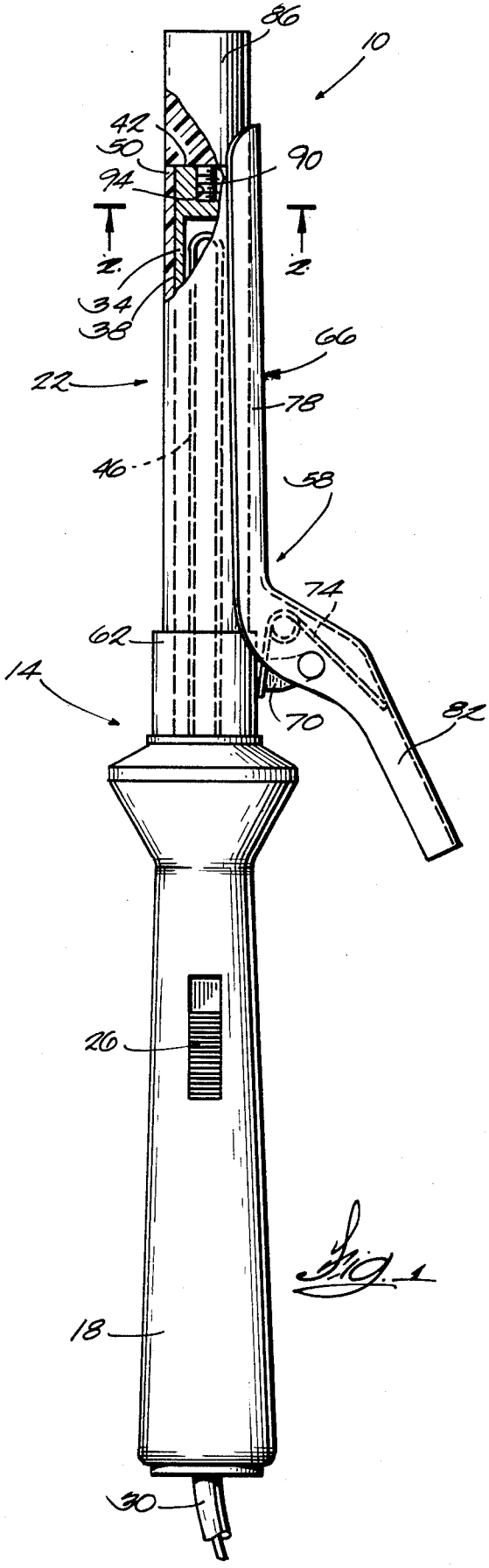
FIG. 1 is a side prospective view, partially broken away, of a hair curling appliance which embodies various of the features of the invention.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and various terms employed herein is for the purpose of description and is not to be regarded as limiting.

DESCRIPTION OF THE PREFERRED EMBODIMENTS

Illustrated in FIG. 1 is one embodiment of a hair curling appliance which takes the form of a hair curler 10. The hair curler 10 includes a handle assembly 14 including a handle 18 and a fixedly extending heating element 22. Also mounted in the handle 18 is an electric switch 26 which controls energization of the heating element 22 and which is connected to an electrical cord 30 exiting from the end of the handle 18. The handle 18 can be constructed in various ways, and in the illustrated construction, comprises a pair of handle sections or halves (only one of which is visible in FIG. 1) which are preferably fabricated of a plastic such as polycarbonate and held together by a pair of screws (not shown).

Figure 2:
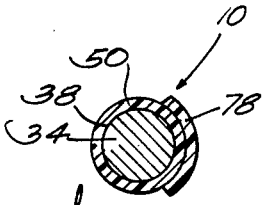
FIG. 2 is a cross-sectional view taken along line 2—2 in FIG. 1.

Referring to FIGS. 1 and 2, the heating element 22 comprises a cylindrical tube or cylinder 34 which includes an outer surface 38 and which is fabricated of heat transmitting metal. The outer end of the metal cylinder 34 is closed by a transverse end wall 42 and the inner end passes into the handle 18 and is fixedly received in the handle halves. The metal cylinder 34 is held against disassembly by a screw (not shown) which passes diametrically through the inner end of the cylinder 34.

Suitably fixed within the metal cylinder 34 is an electrical resistor 46 which is connected to the switch 26 and which, in response to energization thereof, heats the metal cylinder 34.

As illustrated in FIGS. 1 and 2, the heating element 22 also includes an elastomer material covering 50 which covers the outer surface 38 of the metal cylinder 34. Although other constructions can be employed in other embodiments, the elastomer covering 50 is molded on the outer surface 38 of the metal cylinder 34 and has a generally smooth outer surface.

Figure 3:
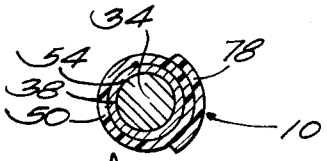
FIG. 3 is a cross-sectional view similar to the cross-sectional view shown in FIG. 2, of an alternate embodiment of a hair curling appliance which embodies various of the features of the invention.

In an alternate embodiment, as shown in FIG. 3, the elastomer material covering 50 is molded to an inner metal tube or cylinder 54 telescopically received on the heating element metal cylinder 34. The inner metal tube 54 can either be attached by suitable means to the metal cylinder 34 or slidably relative to the metal cylinder 34. When slidable relative to the metal cylinder 34, the inner metal tube 54 and elastomer material covering 50 can be removed from the heating element 22, if desired.

While other elastomer materials may be used in other embodiments, the elastomer covering 50 is an elastomeric thermoplastic polyolefinic compound with a hardness ranging between 73 shore A and 50 shore D. This material is substantially softer than the metalic cylinder 34 and thus provides for greater comfort for the hair curler user. The elastomeric thermoplastic polyolefinic compound is a commercially available compound, an example of which is sold by the Mansanto Industrial Chemical Co., Rubber Chemicals Division, located at 260 Springside Drive, Akron, Ohio. The compound is described by Monsanto as a thermoplastic rubber and is identified by the federally registered trademark of Santoprene. The Santoprene thermoplastic rubber is sold in hardnesses ranging from 73 shore A to 50 shore D, and numerical hardnesses ranging from 40 to 87.

Suitably attached to the handle assembly 14 is a clamp assembly 58 for clamping hair against the heating element 22. More particularly, in the illustrated embodiment, the clamp assembly 58 comprises a cylindrical member 62 which is telescopically received on the inner end of the heating element 22, and a clamp member 66 which is pivotally connected to a tab 70 extending radially outwardly from the cylindrical member 62. Located between the cylindrical member 62 and the clamp member 66 is biasing means in the form of a spring 74 for biasing the clamp member 66 toward the heating element 22.

The clamp member 66 includes a clamp portion 78 substantially co-extensive with the heating element 22 and movable between a first position adjacent the heating element 22 and a second position wherein one end is spaced from the heating element 22. The clamp member 66 also includes a tab portion 82 which is spaced apart from the handle 18 in the first position and adjacent the heating element 22 in the second position. The tab portion 82 can be depressed by the hair curling appliance operator to pivot the clamp portion 78 about the tab 70 and away from the heating element 22. In other embodiments (not shown), the clamp assembly 58 can be connected to the handle 18, and the elastomer covering 50 can only extend to the cylindrical member 62.

The handle assembly 14 further includes a plug shaped end member 86 attached to the outer end of the metal cylinder 34. The end member 86 is preferrably made of non-heat conducting plastic and can be grasped by the curling appliance user when hair is being curled or wrapped onto the heating element 22. The end member 86 has an outer diameter generally equal to the outer diameter of the heating element 22. The end member 86 is secured to the outer end of the heating element 22 by a threaded pin extension 90 received in a bore 94 centrally located in the end wall 42 of the heating element 22.

Various of the features of the invention are set forth in the following claims.

I claim:

1. A hair curling appliance including a handle, and a heating element including a metal cylinder fixedly extending from said handle and including an outer surface, and an outer covering which is made of elastomer material and which substantially covers said outer surface of said metal cylinder.

2. A hair curling appliance in accordance with claim 1 wherein said outer covering is attached to said metal cylinder.

3. A hair curling appliance according to claim 1 wherein said heating element further includes an intermediate metal tube which includes an outer surface and which is removably telescopically received on said metal cylinder, and wherein said outer covering is attached to and also substantially covers said outer surface of said intermediate metal tube.

4. A hair curling appliance in accordance with claim 3 wherein said intermediate metal tube is slidable relative to said metal cylinder.

5. A hair curling appliance in accordance with claim 1 and further including a clamping assembly for clamping hair to said heating element.

6. A hair curling appliance in accordance with claim 1 wherein said elastomer material is an elastomeric plastic.

7. A hair curling appliance in accordance with claim 6 wherein said elastomeric plastic is a thermoplastic polyefinic compound with a hardness ranging between 73 shore A and 50 shore D.

8. A hair curling appliance in accordance with claim 1 wherein said outer covering includes a generally smooth outer surface.

9. A hair curling appliance including a handle, and a heating element including a metal cylinder fixedly extending from said handle and including an outer surface, and an outer covering which is made of an elastomeric plastic and which substantially covers said outer surface of said metal cylinder, and which includes a generally smooth outer surface.

10. A hair curling appliance in accordance with claim 9 wherein said outer covering is attached to said metal cylinder.

11. A hair curling appliance according to claim 9 wherein said heating element further includes an intermediate metal tube which includes an outer surface and which is removably telescopically received on said metal cylinder, and wherein said outer covering is attached to and also substantially covers said outer surface of said intermediate metal tube.

12. A hair curling appliance in accordance with claim 11 wherein said intermediate metal tube is slidable relative to said metal cylinder.

13. A hair curling appliance in accordance with claim 9 and further including a clamping assembly for clamping hair to said heating element.

14. A hair curling appliance including a handle, and a heating element including a metal cylinder fixedly extending from said handle and including an outer surface, and an outer covering which is made of a thermoplastic polyefinic compound with a hardness ranging between 73 shore A and 50 shore D and which substantially covers said outer surface of said metal cylinder, and which includes a generally smooth outer surface.

15. A hair curling appliance in accordance with claim 14 wherein said outer covering is attached to said metal cylinder.

16. A hair curling appliance according to claim 14 wherein said heating element further includes an intermediate metal tube which includes an outer surface and which is removably telescopically received on said metal cylinder, and wherein said outer covering is attached to and also substantially covers said outer surface of said intermediate metal tube.

17. A hair curling appliance in accordance with claim 16 wherein said intermediate metal tube is slidable relative to said metal cylinder.

18. A hair curling appliance in accordance with claim 14 and further including a clamping assembly for clamping hair to said heating element.

* * * * *